US010781603B1

(12) United States Patent
Darragh

(10) Patent No.: US 10,781,603 B1
(45) Date of Patent: Sep. 22, 2020

(54) MAST RAISING ASSEMBLY

(71) Applicant: David Darragh, Henderson, TX (US)

(72) Inventor: David Darragh, Henderson, TX (US)

( * ) Notice: Subject to any disclaimer, the term of this patent is extended or adjusted under 35 U.S.C. 154(b) by 0 days.

(21) Appl. No.: 16/660,428

(22) Filed: Oct. 22, 2019

(51) Int. Cl.
*E04B 1/00* (2006.01)
*E04H 12/34* (2006.01)
*E04H 12/18* (2006.01)

(52) U.S. Cl.
CPC ..... *E04H 12/345* (2013.01); *E04H 12/18* (2013.01); *B66D 2700/0116* (2013.01)

(58) Field of Classification Search
None
See application file for complete search history.

(56) References Cited

U.S. PATENT DOCUMENTS

| | | | |
|---|---|---|---|
| 2,213,870 | A | 9/1940 | Scholl |
| 2,822,066 | A | 2/1958 | Hanson |
| 2,875,865 | A | 3/1959 | Rohn |
| 3,977,139 | A | 8/1976 | Bryant |
| 4,167,740 | A | 9/1979 | Shriver |
| 4,362,451 | A | 12/1982 | Thiermann |
| 8,910,432 | B2 | 12/2014 | Egan |

*Primary Examiner* — Basil S Katcheves

(57) ABSTRACT

A mast raising assembly includes a base that is securable to a horizontal support surface. A tube is insertable into the base such that the tube is vertically oriented. A winch is coupled to the tube and a pair of lower pulleys is each rotatably coupled to the tube. A mast is pivotally coupled to the tube. The mast is positionable in a raised position and a folded position. A plurality of upper pulleys is each of the upper pulleys is rotatably coupled to the mast. A cable extends between the winch, the lower pulleys and the upper pulleys. The cable urges the mast into the raised position when the winch is rotated in a raising direction. Additionally, the cable urges the mast into the folded position when the winch is rotated in a lowering direction.

9 Claims, 7 Drawing Sheets

MAST RAISING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to mast raising device and more particularly pertains to a new mast raising device for raising and lowering a mast with a hand crank.

(2) Description of Related Art Including Information Disclosed Under 37 CFR 1.97 and 1.98

The prior art relates to mast raising device.

BRIEF SUMMARY OF THE INVENTION

An embodiment of the disclosure meets the needs presented above by generally comprising a base that is securable to a horizontal support surface. A tube is insertable into the base such that the tube is vertically oriented. A winch is coupled to the tube and a pair of lower pulleys is each rotatably coupled to the tube. A mast is pivotally coupled to the tube. The mast is positionable in a raised position and a folded position. A plurality of upper pulleys is each of the upper pulleys is rotatably coupled to the mast. A cable extends between the winch, the lower pulleys and the upper pulleys. The cable urges the mast into the raised position when the winch is rotated in a raising direction. Additionally, the cable urges the mast into the folded position when the winch is rotated in a lowering direction.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
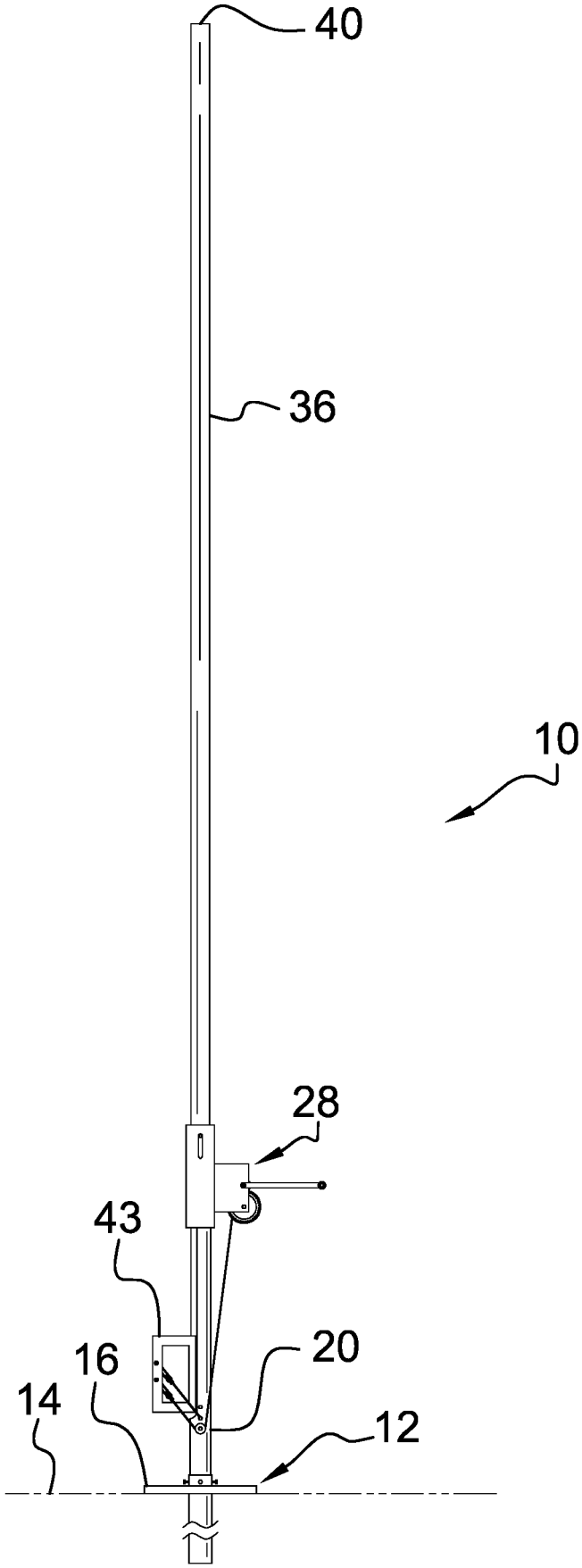
FIG. 1 is a perspective view of a mast raising assembly according to an embodiment of the disclosure.
Figure 2:
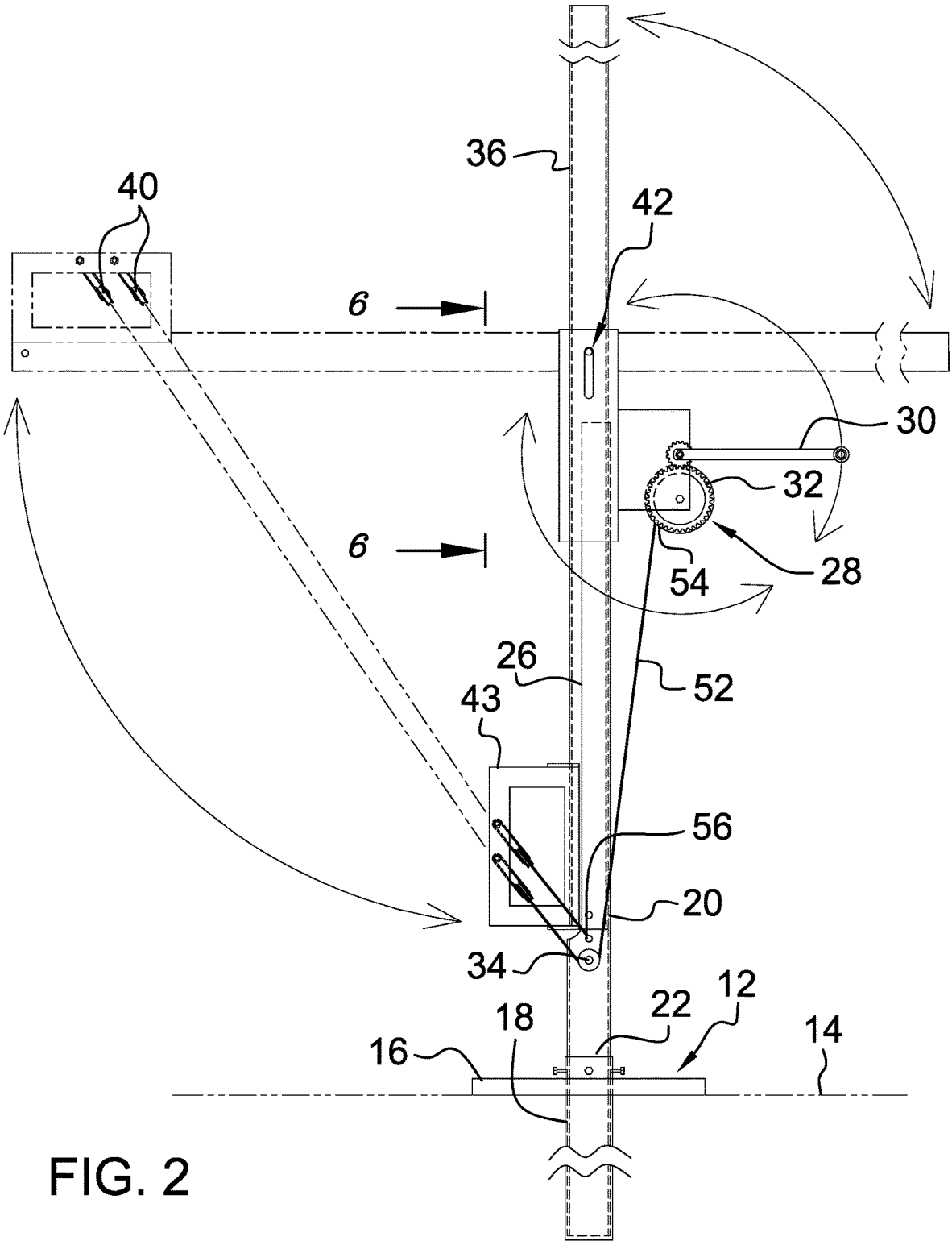
FIG. 2 is a right side view of an embodiment of the disclosure showing a mast moving between a raised position and a folded position.
Figure 3:
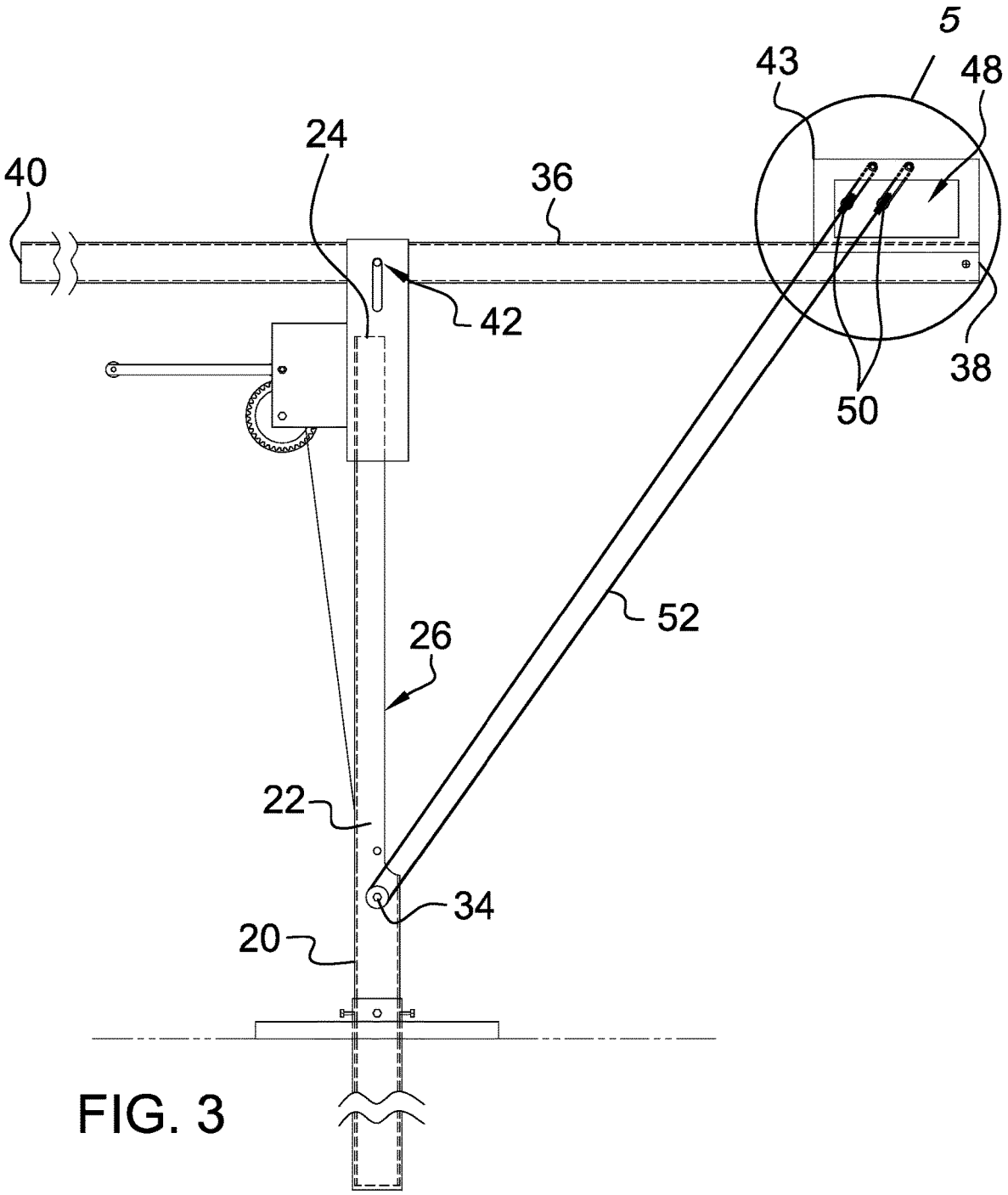
FIG. 3 is a left side view of an embodiment of the disclosure showing a mast in a folded position.
Figure 4:
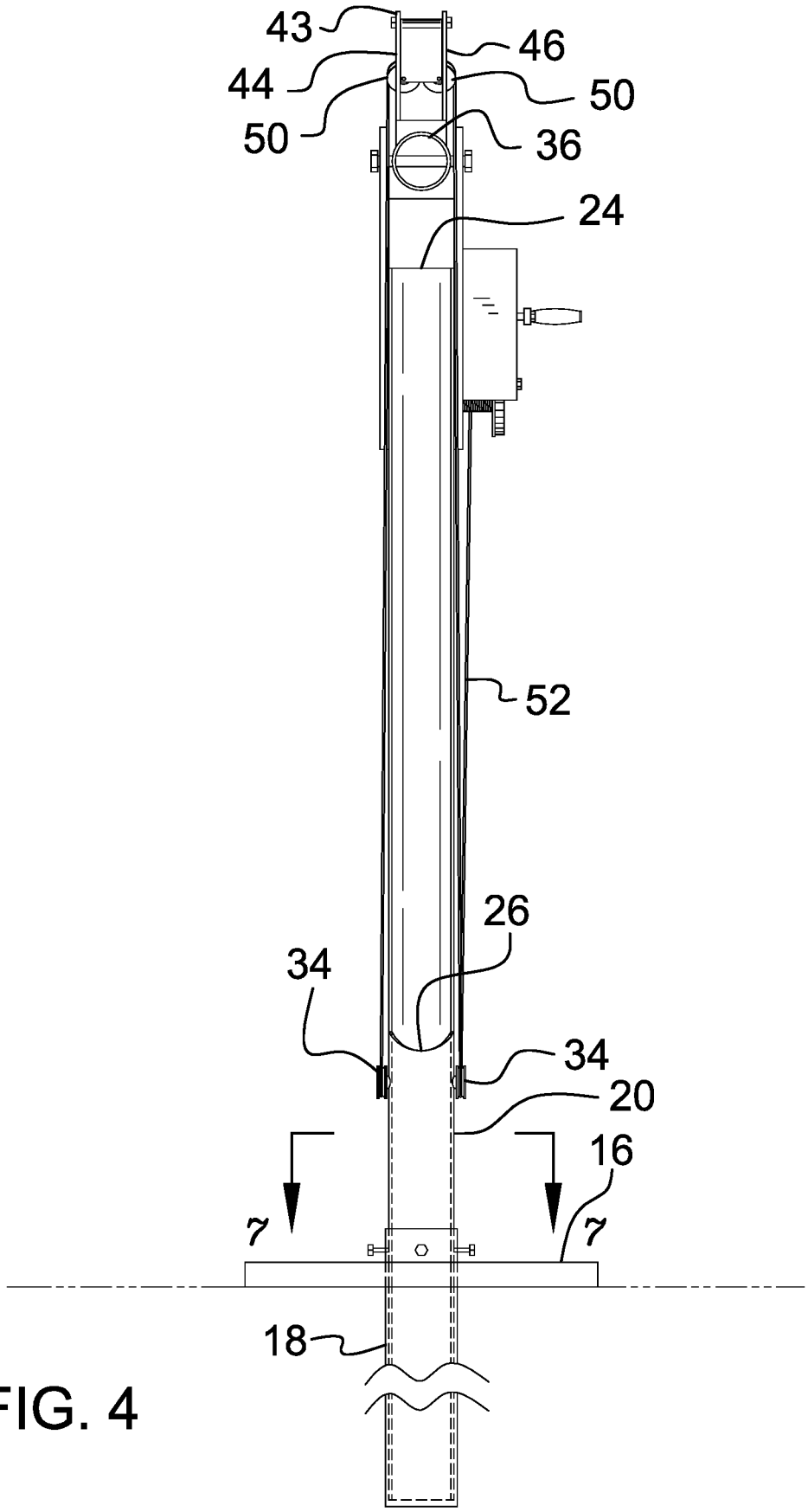
FIG. 4 is a front view of an embodiment of the disclosure showing a mast in a folded position.
Figure 5:
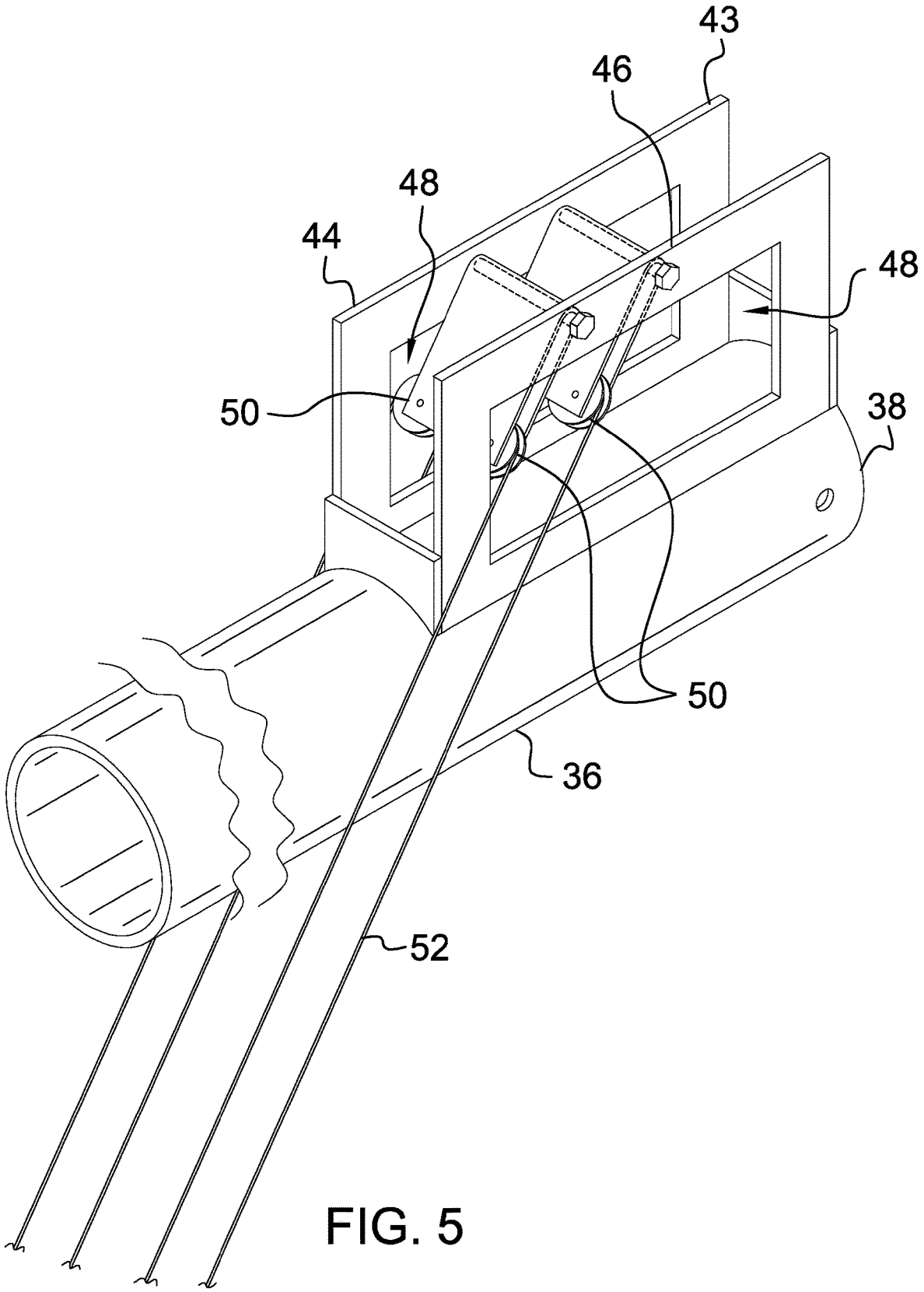
FIG. 5 is a detail view taken from circle 5 of FIG. 3 of an embodiment of the disclosure.
Figure 6:
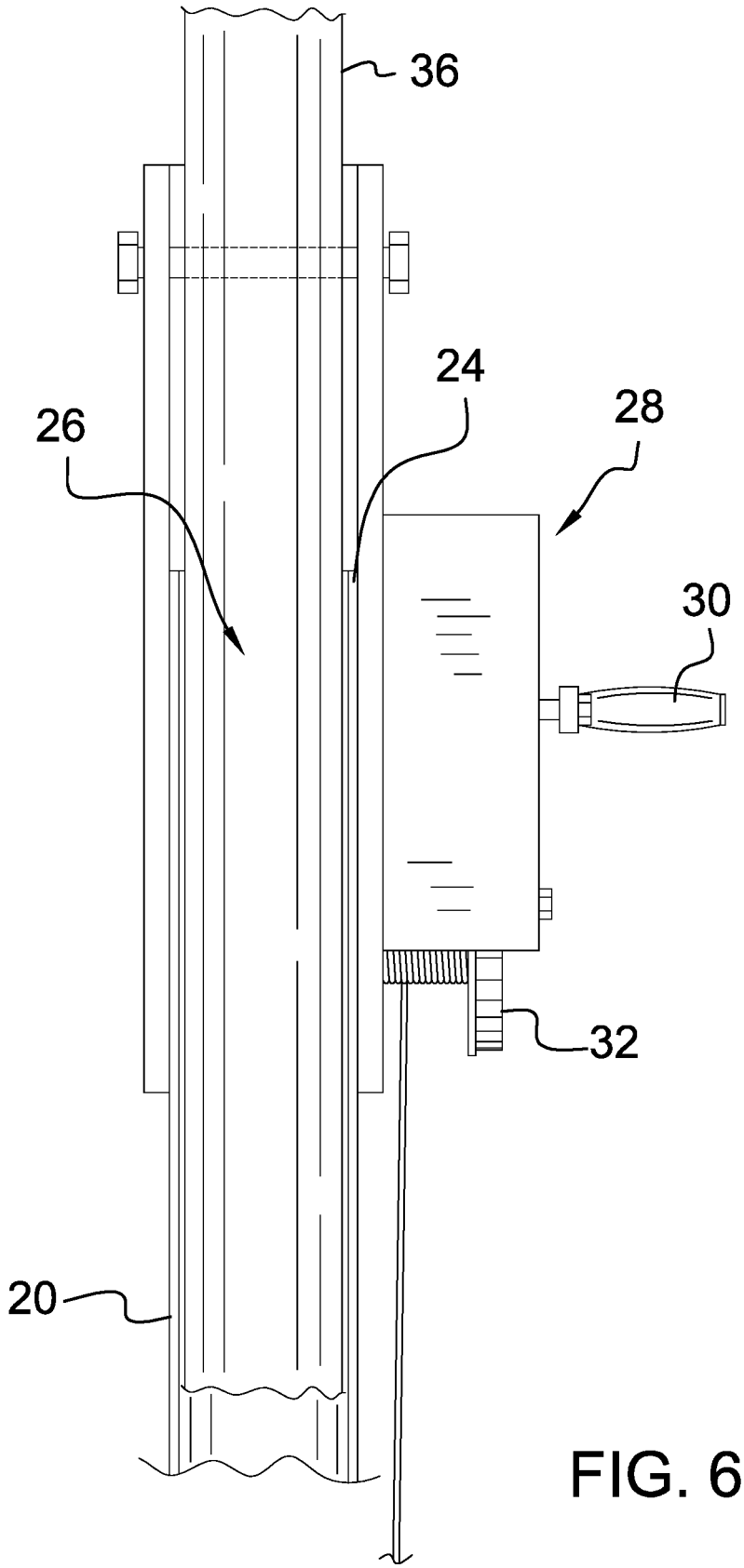
FIG. 6 is a front view of winch and a tube of an embodiment of the disclosure.
Figure 7:
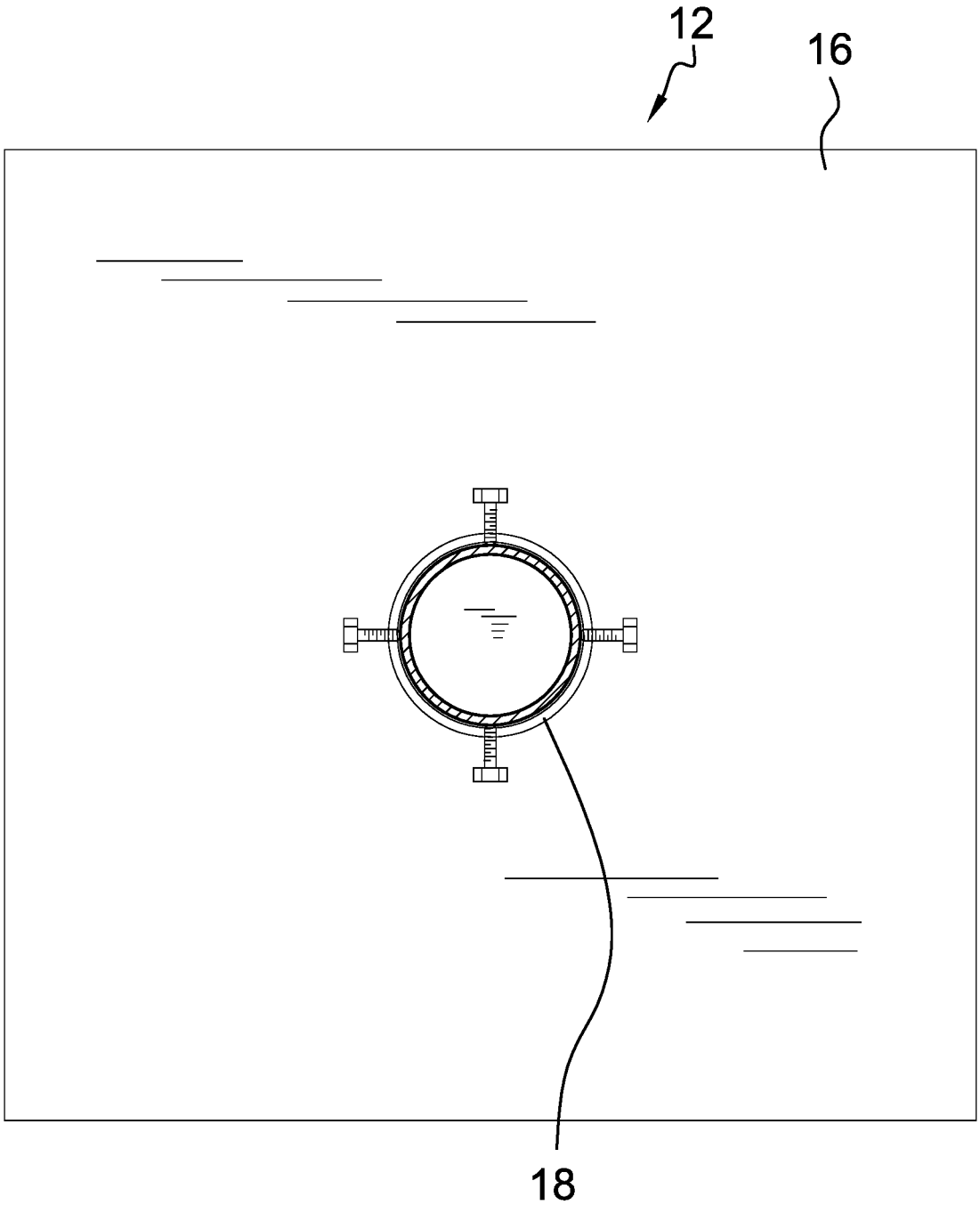
FIG. 7 is a cross sectional view taken along line 7-7 of FIG. 4 of an embodiment of the disclosure.

With reference now to the drawings, and in particular to FIGS. 1 through 7 thereof, a new mast raising device embodying the principles and concepts of an embodiment of the disclosure and generally designated by the reference numeral 10 will be described.

As best illustrated in FIGS. 1 through 7, the mast raising assembly 10 generally comprises a base 12 that is securable to a horizontal support surface 14. The horizontal support surface 14 may be a concrete pad, the ground or other similar horizontal support surface 14. The base 12 comprises a plate 16 and a receiver 18 extending through the plate 16. The plate 16 lies on the horizontal support surface 14 having the receiver 18 extending downwardly into the horizontal support surface 14. In this way the plate 16 is inhibited from moving on the horizontal support surface 14.

A tube 20 is provided and the tube 20 is insertable into the receiver 18 such that the tube 20 is vertically oriented. The tube 20 has an outer wall 22 and a distal end 24 with respect to the plate 16. The outer wall 22 has a cut out 26 extending into an interior of the tube 20 and the cut out 26 extends from the distal end 24 toward the receiver 18. A winch 28 is removably coupled to the tube 20, and the winch 28 includes a handle 30 and a cable wheel 32. The handle 30 is in mechanical communication with the cable wheel 32 such that the handle 30 rotates the cable wheel 32 when the handle 30 is rotated. Additionally, the winch 28 is offset with respect to the cut out 26 in the tube 20. The winch 28 may be a hand operated winch of any conventional design. The winch 28 may be retained on the tube 20 with a pair of U-bolts or other releasable fastener.

A pair of lower pulleys 34 is provided and each of the lower pulleys 34 is rotatably coupled to the tube 20. Each of the lower pulleys 34 is positioned on opposite sides of the outer wall 22 of the tube 20 with respect to each other. A mast 36 is provided and the mast 36 is pivotally coupled to the tube 20. The mast 36 is positionable in a raised position having the mast 36 being vertically oriented. Additionally, the mast 36 is positionable in a folded position having the mast 36 being oriented perpendicular to the tube 20.

The mast 36 has a first end 38 and a second end 40. The mast 36 is pivotally coupled to the distal end 24 of the tube 20 at a pivot point 42 that is located closer to the first end 38 than the second end 40. The mast 36 enters the cut out 26 in the tube 20 when the mast 36 is positioned in the raised position. Additionally, the first end 38 of the mast 36 is positioned in the tube 20 when the mast 36 is positioned in the raised position. The mast 36 may have a length of at least 50.0 feet.

A pulley mount 43 is removably coupled to the mast 36 and the pulley mount 43 is positionable adjacent to the first end 38 of the mast 36. The pulley mount 43 has a first lateral wall 44 and a second lateral wall 46. Each of the first lateral wall 44 and the second lateral wall 46 has an opening 48 extending therethrough. A plurality of upper pulleys 50 is provided and each of the upper pulleys 50 is rotatably coupled to the pulley mount 43. Each of the upper pulleys 50 is aligned with the opening 48 in a respective one of the first lateral wall 44 and the second lateral wall 46. The pulley mount 43 may be retained on the mast 36 with U-bolts or other releasable fastener.

A cable 52 is provided and the cable 52 extends between the winch 28, the lower pulleys 34 and the upper pulleys 50. The cable 52 urges the mast 36 into the raised position when the winch 28 is rotated in a raising direction. Conversely, the cable 52 urges the mast 36 into the folded position when the winch 28 is rotated in a lowering direction. The cable 52 may be a steel cable, a rope cable or any other cable that has a weight capacity of at least 500.0 pounds.

The cable 52 has a first end 54 and a second end 56. The first end 54 of the cable 52 is coupled to the cable wheel 32 of the winch 28 and the second end 56 of the cable 52 is coupled to the tube 20. The cable 52 is shortened when the winch 28 is rotated in the raising direction thereby urging the first end 38 of the mast 36 into the cut out 26 of the tube 20. The cable 52 is lengthened when the winch 28 is rotated in the lowering direction thereby facilitating the mast 36 to be lowered into the folded position. The cable 52 extends through the opening 48 in each of the first lateral wall 44 and the second lateral wall 46 of the pulley mount 43.

In use, the base 12 is mounted at a selected location and the tube 20 is inserted into the receiver 18. The winch 28 is coupled to the tube 20 and the pulley mount 43 is coupled to the mast 36 at a point that is adjacent to the first end 38 of the mast 36. An antenna, a lamp or any other object that is intended to be elevated is coupled to the second end 40 of the mast 36. Additionally, the cable 52 is routed between the winch 28 and the pulley mount 43. The winch 28 is rotated in the raising direction to urge the mast 36 into the raised position. In this way the antenna, lamp or other object can be elevated without the need for a lift truck or other powered equipment. The winch 28 is rotated in the lowering direction to urge the mast 36 into the folded position. In this way the antenna, lamp or other object can be accessed by a person standing on the ground. Each of the winch 28 and the pulley mount 43 are removable from the tube 20 and the mast 36 when the mast 36 has been raised into the raised position to present a more clean appearance.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A mast raising assembly being configured to raise a mast without the use of power equipment, said assembly comprising:

a base being securable to a horizontal support surface, said base comprising a plate and a receiver extending through said plate, said plate lying on the horizontal support surface having said receiver extending downwardly into the horizontal support surface for inhibiting said plate from moving on the horizontal support surface;

a tube being insertable into said receiver such that said tube is vertically oriented;

a winch being removably coupled to said tube;

a pair of lower pulleys, each of said lower pulleys being rotatably coupled to said tube;

a mast being pivotally coupled to said tube, said mast being positionable in a raised position having said mast being vertically oriented, said mast being positionable in a folded position having said mast being oriented perpendicular to said tube;

a pulley mount being removably coupled to said mast;

a plurality of upper pulleys, each of said upper pulleys being rotatably coupled to said pulley mount;

a cable extending between said winch, said lower pulleys and said upper pulleys, said cable urging said mast into said raised position when said winch is rotated in a raising direction, said cable urging said mast into said folded position when said winch is rotated in a lowering direction.

2. The assembly according to claim 1, wherein said tube has an outer wall and a distal end with respect to said plate, said outer wall having a cut out extending into an interior of said tube, said cut out extending from said distal end toward said receiver.

3. The assembly according to claim 2, wherein said winch includes a handle and a cable wheel, said handle being in mechanical communication with said cable wheel such that said handle rotates said cable wheel when said handle is rotated, said winch being offset with respect to said cut out in said tube.

4. The assembly according to claim 2, wherein each of said lower pulleys is positioned on opposite sides of said outer wall of said tube with respect to each other.

5. The assembly according to claim 2, wherein said mast has a first end and a second end, said mast being pivotally coupled to said distal end of said tube at a pivot point being located closer to said first end than said second end, said mast entering said cut out in said tube when said mast is positioned in said raised position such that said first end of said mast is positioned in said tube when said mast is positioned in said raised position.

6. The assembly according to claim 5, wherein said pulley mount is positionable adjacent to said first end of said mast, said pulley mount having a first lateral wall and a second lateral wall, each of said first lateral wall and said second lateral wall having an opening extending therethrough.

7. The assembly according to claim 6, wherein each of said upper pulleys is aligned with said opening in a respective one of said first lateral wall and said second lateral wall.

8. The assembly according to claim 7, further comprising said cable has a first end and a second end, said first end being coupled to said cable wheel of said winch, said second end being coupled to said tube, said cable being shortened when said winch is rotated in said raising direction thereby urging said first end of said mast into said cut out of said tube, said cable being lengthened when said winch is rotated in said lowering direction, said cable extending through said opening in each of said first lateral wall and said second lateral wall of said pulley mount.

9. A mast raising assembly being configured to raise a mast without the use of power equipment, said assembly comprising:

a base being securable to a horizontal support surface, said base comprising a plate and a receiver extending through said plate, said plate lying on the horizontal support surface having said receiver extending downwardly into the horizontal support surface for inhibiting said plate from moving on the horizontal support surface;

a tube being insertable into said receiver such that said tube is vertically oriented, said tube having an outer wall and a distal end with respect to said plate, said outer wall having a cut out extending into an interior of said tube, said cut out extending from said distal end toward said receiver;

a winch being removably coupled to said tube, said winch including a handle and a cable wheel, said handle being in mechanical communication with said cable wheel such that said handle rotates said cable wheel when said handle is rotated, said winch being offset with respect to said cut out in said tube;

a pair of lower pulleys, each of said lower pulleys being rotatably coupled to said tube, each of said lower pulleys being positioned on opposite sides of said outer wall of said tube with respect to each other;

a mast being pivotally coupled to said tube, said mast being positionable in a raised position having said mast being vertically oriented, said mast being positionable in a folded position having said mast being oriented perpendicular to said tube, said mast having a first end and a second end, said mast being pivotally coupled to said distal end of said tube at a pivot point being located closer to said first end than said second end, said mast entering said cut out in said tube when said mast is positioned in said raised position such that said first end of said mast is positioned in said tube when said mast is positioned in said raised position;

a pulley mount being removably coupled to said mast, said pulley mount being positionable adjacent to said first end of said mast, said pulley mount having a first lateral wall and a second lateral wall, each of said first lateral wall and said second lateral wall having an opening extending therethrough;

a plurality of upper pulleys, each of said upper pulleys being rotatably coupled to said pulley mount, each of said upper pulleys being aligned with said opening in a respective one of said first lateral wall and said second lateral wall; and a cable extending between said winch, said lower pulleys and said upper pulleys, said cable urging said mast into said raised position when said winch is rotated in a raising direction, said cable urging said mast into said folded position when said winch is rotated in a lowering direction, said cable having a first end and a second end, said first end being coupled to said cable wheel of said winch, said second end being coupled to said tube, said cable being shortened when said winch is rotated in said raising direction thereby urging said first end of said mast into said cut out of said tube, said cable being lengthened when said winch is rotated in said lowering direction, said cable extending through said opening in each of said first lateral wall and said second lateral wall of said pulley mount.

* * * * *